US008465189B2

(12) United States Patent
Inoue et al.

(10) Patent No.: US 8,465,189 B2
(45) Date of Patent: Jun. 18, 2013

(54) VEHICULAR HEADLAMP

(75) Inventors: Takashi Inoue, Shizuoka (JP); Takanori Namba, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 566 days.

(21) Appl. No.: 12/729,714

(22) Filed: Mar. 23, 2010

(65) Prior Publication Data

US 2010/0253223 A1 Oct. 7, 2010

(30) Foreign Application Priority Data

Apr. 1, 2009 (JP) ..... 2009-089415

(51) Int. Cl.
*B60Q 1/00* (2006.01)

(52) U.S. Cl.
USPC ..... 362/547; 362/294; 362/257

(58) Field of Classification Search
USPC ..... 315/80, 82, 291, 307, 112, 117–118; 362/459–460, 462–463, 545–549, 257, 294
See application file for complete search history.

(56) References Cited

U.S. PATENT DOCUMENTS 6,595,672 B2 * 7/2003 Yamaguchi ..... 362/547
7,985,013 B2 * 7/2011 Yasuda ..... 362/547
2007/0025117 A1 2/2007 Watanabe et al.
2007/0035957 A1 * 2/2007 Albou et al. ..... 362/487
2009/0034279 A1 * 2/2009 Blandin et al. ..... 362/512
2009/0195159 A1 * 8/2009 Smith ..... 315/33

FOREIGN PATENT DOCUMENTS

JP 2006-294263 A 10/2006
JP 2007-035547 A 2/2007

OTHER PUBLICATIONS

English abstract of JP2006294263 published on Oct. 26, 2006, 1 page.
English abstract of JP2007035547 published on Feb. 8, 2007, 1 page.

* cited by examiner

*Primary Examiner* — Jacob Y Choi
*Assistant Examiner* — Henry Luong
(74) *Attorney, Agent, or Firm* — Osha Liang LLP

(57) ABSTRACT

A vehicular headlamp, wherein a light source unit for light distribution formation is accommodated inside a lamp chamber defined by a lamp body and a front cover, includes a metal heat transfer member that serves as a light source unit structural member; a light-emitting element that serves as a light source; a fan for cooling the light-emitting element provided inside the lamp chamber; and a lighting circuit that controls lighting of the light-emitting element. The light-emitting element, the fan, and the lighting circuit are each attached to the metal heat transfer member.

12 Claims, 4 Drawing Sheets

10

VEHICULAR HEADLAMP

BACKGROUND OF INVENTION

1. Field of the Invention

The present invention relates to a vehicular headlamp, in which a light source unit for light distribution formation is accommodated inside a lamp chamber that is defined by a lamp body and a front cover, and the light source unit is provided with a metal heat transfer member.

2. Related Art

Various vehicular headlamps have been proposed in recent years with configurations that accommodate a light source unit for light distribution formation, which has a light-emitting element such as a light-emitting diode as a light source, within a lamp chamber in order to reduce power consumption. However, the amount of heat generated by the light-emitting element has become a concern over the course of developing a light-emitting element capable of achieving a high light flux that matches the light intensity required for headlamp light distribution. In other words, while a light-emitting element capable of high light flux can achieve a high light flux, correspondingly, a large amount of heat is generated. This leads to problems of reduced luminous efficiency and variations in the color of light emitted.

Patent Document 1 describes a structure (headlamp) in which a projecting portion is formed on a metal heat transfer member that serves as a light source unit structural member attached with a light-emitting element. A blast fan is provided at a predetermined position on the inner side of a lamp body. Air blowing from the blast fan hits the projecting portion of the metal heat transfer member and promotes the release of heat from the projecting portion. Thus, the light-emitting element is cooled.

Although this type of headlamp is equipped with a lighting circuit that controls lighting of the light-emitting element, Patent Document 1 makes no mention of a lighting circuit. Patent Document 2, similar to Patent Document 1, describes a structure (headlamp) in which a light-emitting element is attached to a metal heat transfer material that serves as a light source unit structural member, and a lighting circuit is provided outside a lamp chamber (on a lower surface of a lamp body) so that the lighting circuit (electronic components that structure the lighting circuit) is not affected by the heat of the light-emitting element.

[Patent Document 1] Japanese Patent Application Laid-Open (Kokai) No. 2006-294263

[Patent Document 2] Japanese Patent Application Laid-Open (Kokai) No. 2007-35547

SUMMARY OF INVENTION

In Patent Document 2, because the lighting circuit is provided outside of the lamp chamber, the size of the lamp is increased by a corresponding amount.

In addition, the light-emitting element inside the lamp chamber must be connected by a lead to the lighting circuit outside the lamp chamber and this requires cumbersome work. In this type of headlamp in particular, the light source unit is generally formed tiltable by an aiming mechanism. Therefore, the lead must be arranged in a manner that does not interfere with an aiming mechanism structural member disposed inside the lamp chamber or with the light source unit tilted by aiming. Such an arrangement contributes to a more complex structure inside the lamp chamber.

In one or more embodiments, by integratedly attaching the lighting circuit to the metal heat transfer member that serves as a light source structural member, the lamp is made more compact and the internal structure of the lamp chamber is simplified without requiring a lead to be installed inside the lamp chamber.

However, it is difficult to effectively cool both the light-emitting element and the lighting circuit integratedly attached to the metal heat transfer member by simply providing a blast fan at a predetermined position on the inner side of the lamp body as in Patent Document 1. In other words, because the light source unit is formed tiltable by the aiming mechanism, aiming the light source unit causes displacement in the positional relationship between the light source unit (the light-emitting element and the lighting circuit on the light source unit side) and the blast fan (displacement of the blowing direction of the blast fan with respect to the light-emitting element and the lighting circuit on the light source unit side). Thus, the cooling of the light-emitting element and the lighting circuit is affected by the displacement.

In one or more embodiments, the blast fan is also attached to the metal heat transfer member to integrate the blast fan as part of the light source unit. That is, attaching the light-emitting element, the lighting circuit, and the blast fan to the metal heat transfer member that serves as a light source unit structural member achieves an integrated structure, which acts as a light source unit, and simplifies the internal structure of the lamp chamber. Furthermore, even when aiming adjustments are performed (when the light source unit is tiltably adjusted), the arrangement of the blast fan with respect to the light-emitting element and the lighting circuit does not change. Therefore, the cooling effect on the light-emitting element and the lighting circuit due to the blast fan can be constantly maintained.

When a prototype of a headlamp (light source unit) with such a configuration was created to verify this effect, the configuration was confirmed as effective.

One or more embodiments of the present invention provide a vehicular headlamp that has a compact external lamp shape and a simple internal lamp chamber structure. By attaching a light-emitting element, a lighting circuit, and a blast fan to a metal heat transfer member, which serves as a light source unit structural member, and integrating these as a light source unit, the headlamp can effectively cool both the light-emitting element and the lighting circuit.

In a vehicular headlamp according to one or more embodiments of the present invention, a light source unit for light distribution formation is accommodated inside a lamp chamber defined by a lamp body and a front cover, and provided with a metal heat transfer member that serves as a light source unit structural member, a light-emitting element that serves as a light source, and blowing means for cooling the light-emitting element provided inside the lamp chamber, and a lighting circuit that controls lighting of the light-emitting element. The light-emitting element, the blowing means, and the lighting circuit are each attached to the metal heat transfer member.

Here, the "light-emitting element" refers to a light source in element form having a light-emitting chip that emits light in a general point configuration. The type of light-emitting element is not particularly limited, and a light-emitting diode, a laser diode, or the like may be employed, for example.

The "metal heat transfer member" may be produced by any method, such as press molding, cut-forming, die-casting, or the like, provided that it is made of metal. An aluminum die cast product is most preferable in consideration of heat conductivity, weight saving, and workability.

The lighting circuit that controls lighting of the light-emitting element is integrated into (the metal heat transfer member that structures) the light source unit. Therefore, as in Patent Document 2, the lighting circuit does not protrude to outside of the lamp chamber, and there is no need to arrange a lead inside the lamp chamber for connecting the light-emitting element and the lighting circuit.

Blown air generated by the blowing means integrated into the light source unit (metal heat transfer member) cools both the light-emitting element and the lighting circuit. The light source unit is provided tiltable with respect to the lamp body by an aiming mechanism. However, even if the light source unit is tilted by aiming, the arrangement of the blowing means with respect to the light-emitting element and the lighting circuit does not change. Therefore, the direction, strength, and amount of blown air generated by the blowing means for the light-emitting element and the lighting circuit is maintained constant regardless of aiming.

Further, the vehicular headlamp of one or more embodiments is constituted such that the lighting circuit is formed from a circuit board mounted with a circuit element, and a ventilation passage for air blown from the blowing means is formed between the circuit board and the metal heat transfer member and disposed apart from the metal heat transfer member.

Blown air generated by the blowing means and flowing along the ventilation passage between the lighting circuit and the metal heat transfer member promotes the release of heat from the metal heat transfer member and the lighting circuit. In other words, the flow of air along the ventilation passage between the lighting circuit and the metal heat transfer member effectively cools the light-emitting element and the lighting circuit.

In the vehicular headlamp of one or more embodiments, the lighting circuit is attached to a back surface side of the metal heat transfer member through a non-heat transfer member that structures a side wall facing the ventilation passage, and the ventilation passage is formed with a cylindrical shape that extends upward.

Heat generated by the light-emitting element is transferred to the lighting circuit through the metal heat transfer member. However, the side wall (non-heat transfer member) interposed between the metal heat transfer member and the lighting circuit prevents the transfer of heat on the metal heat transfer member side to the lighting circuit side.

Blown air guided to the cylindrical ventilation passage flows inside the ventilation passage without spreading to outside the ventilation passage. Therefore, the release of heat from the metal heat transfer member and the lighting circuit is further promoted. In other words, the flow of air along the cylindrical ventilation passage between the lighting circuit and the metal heat transfer member more effectively cools the light-emitting element and the lighting circuit. Blown air generated by the blowing means especially flows from the bottom of the cylindrical ventilation passage upward, which generates air convection that circulates around the light source unit. As a consequence, fresh air is constantly guided from below the light source unit to the ventilation passage, thus even more effectively cooling the light-emitting element and the lighting circuit.

In the vehicular headlamp of one or more embodiments, a heat radiation fin that is generally orthogonal to the ventilation passage and extends in the right-left direction is formed in an area directly opposite the blowing means in the vicinity of an entrance to the ventilation passage on the metal heat transfer member.

The heat radiation fin formed on the metal heat transfer member increases the amount of surface area of the metal heat transfer member that comes in contact with blown air, and thus increases the amount of heat released from the metal heat transfer member. Therefore, a portion of blown air from the blowing means contacts the heat radiation fin in the vicinity of the entrance to the ventilation passage, and promotes the release of heat from the metal heat transfer member. Consequently, the light-emitting element is more effectively cooled.

Blown air that contacts and is warmed by the heat radiation fin is sent sideward of the light source unit by the heat radiation fin. Therefore, only fresh blown air generated by the blowing means and not such warmed blown air is guided to (the entrance of) the ventilation passage. Consequently, the light-emitting element and the lighting circuit are even more effectively cooled.

In the vehicular headlamp of one or more embodiments, the lighting circuit does not protrude to outside of the lamp chamber. Therefore, the external lamp shape can be made more compact and there is no need to arrange a lead inside the lamp chamber for connecting the light-emitting element and the lighting circuit. Thus, a simple internal lamp chamber structure can be achieved.

The light-emitting element and the lighting circuit are both cooled by blown air generated by the blowing means. Therefore, it is possible to avoid troubles caused by the light-emitting element generating heat, such as reduced luminous efficiency due to the heat generated by the light-emitting element, variations in the color of light emitted, and failures of electronic components structuring the lighting circuit due to the heat generated by the light-emitting element.

In particular, the direction, strength, and amount of effective blown air generated by the blowing means for cooling the light-emitting element and the lighting circuit is maintained constant regardless of aiming, and a constant heat release effect is secured for the light-emitting element and the lighting circuit. As a consequence, it is possible to reliably avoid troubles caused by the light-emitting element generating heat.

According to one or more embodiments, the light-emitting element and the lighting circuit are effectively cooled when blown air generated by the blowing means flows along the ventilation passage between the lighting circuit and the metal heat transfer member. Therefore, any trouble due to heat generated by the light-emitting element can be avoided.

According to one or more embodiments, the transfer of heat generated by the light-emitting element to the lighting circuit is prevented by the side wall (non-heat transfer member) interposed between the metal heat transfer member and the lighting circuit. In addition, blown air guided to the ventilation passage flows directly inside the ventilation passage without spreading. Therefore, the light-emitting element and the lighting circuit can be effectively cooled, and any trouble in the lighting circuit due to heat generated by the light-emitting element can be avoided. In particular, circulating air convection that is generated around the light source unit guides fresh below the light source unit into the ventilation passage. Therefore, the light-emitting element and the lighting circuit are more effectively cooled, and troubles in the lighting circuit due to heat generated by the light-emitting element can be reliably avoided.

According to one or more embodiments, the amount of heat released from the metal heat transfer member increases by an amount corresponding to the heat released by the heat radiation fin. Therefore, the light-emitting element is even more effectively cooled, and the cooling effect on the light-emitting element and the lighting circuit due to blown air flowing through the ventilation passage is further increased, which can further prevent any trouble due to heat generated by the light-emitting element.

Other aspects and advantages of the invention will be apparent from the following description, the drawings and the claims.

DETAILED DESCRIPTION

Hereinafter, embodiments of the invention will be described with reference to the drawings.

Figure 1:
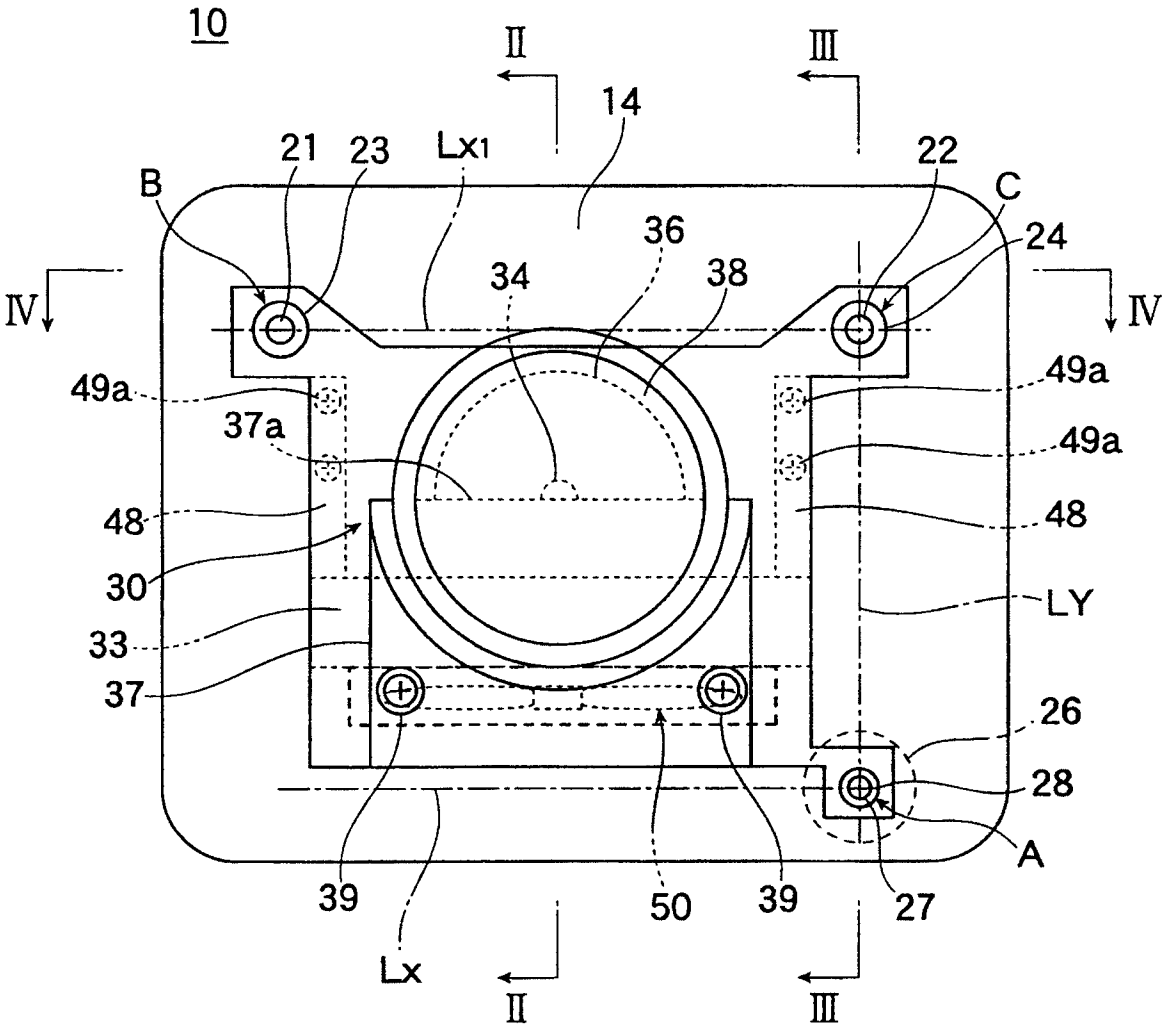
FIG. 1 is a frontal view of a vehicular headlamp according to one or more embodiments of the present invention.
Figure 2:
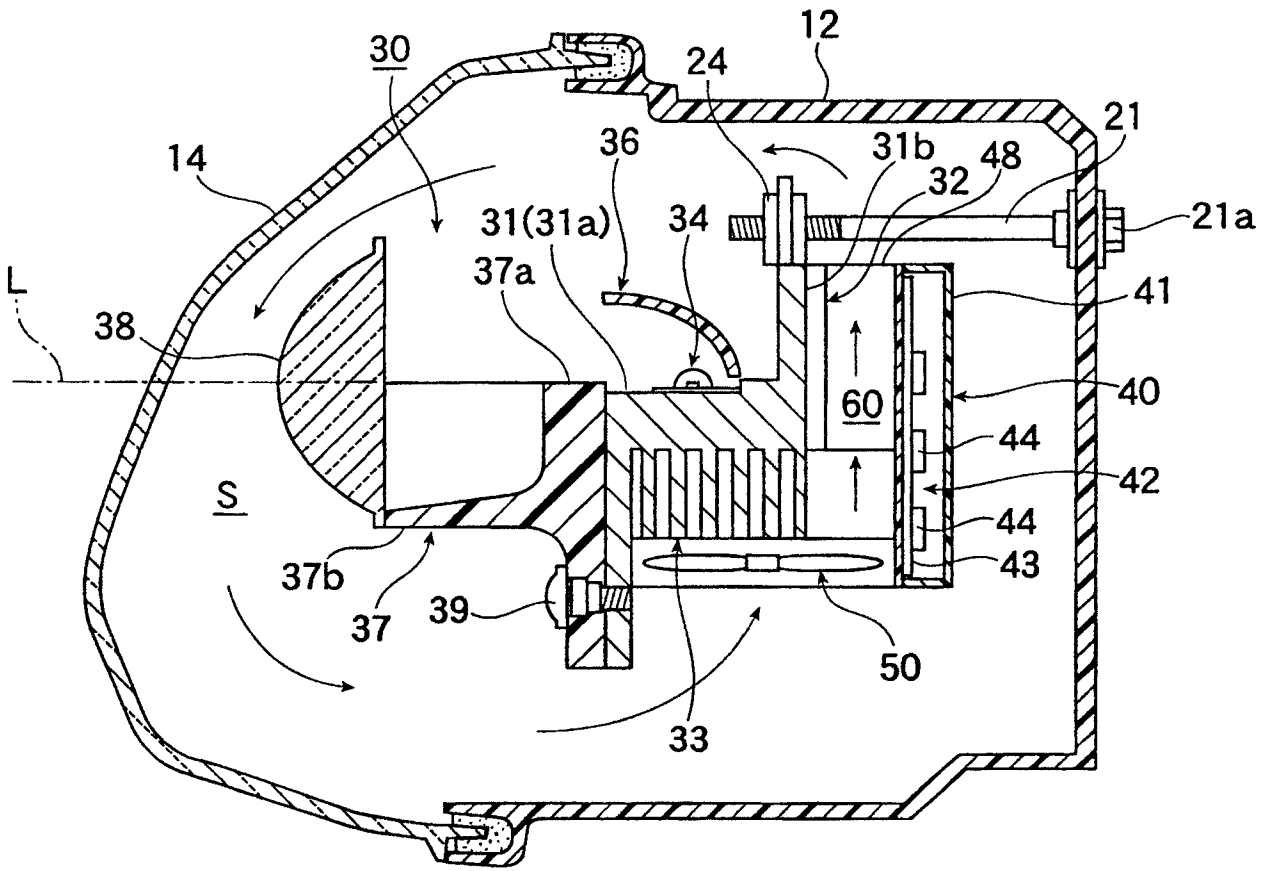
FIG. 2 is a vertical cross-sectional view of the headlamp (cross-sectional view along a line II-II) shown in FIG. 1.
Figure 3:
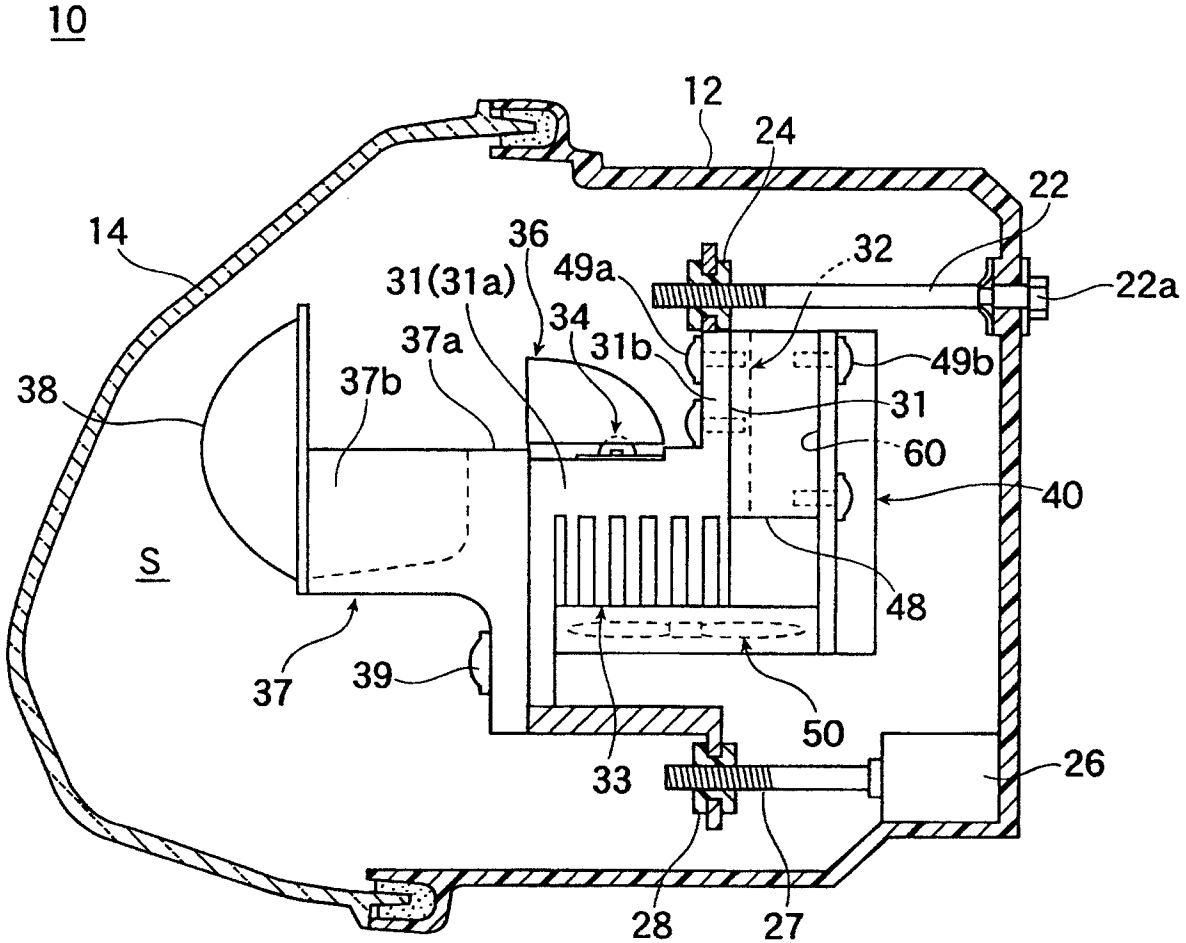
FIG. 3 is a vertical cross-sectional view of the headlamp (cross-sectional view along a line III-III) shown in FIG. 1.
Figure 4:
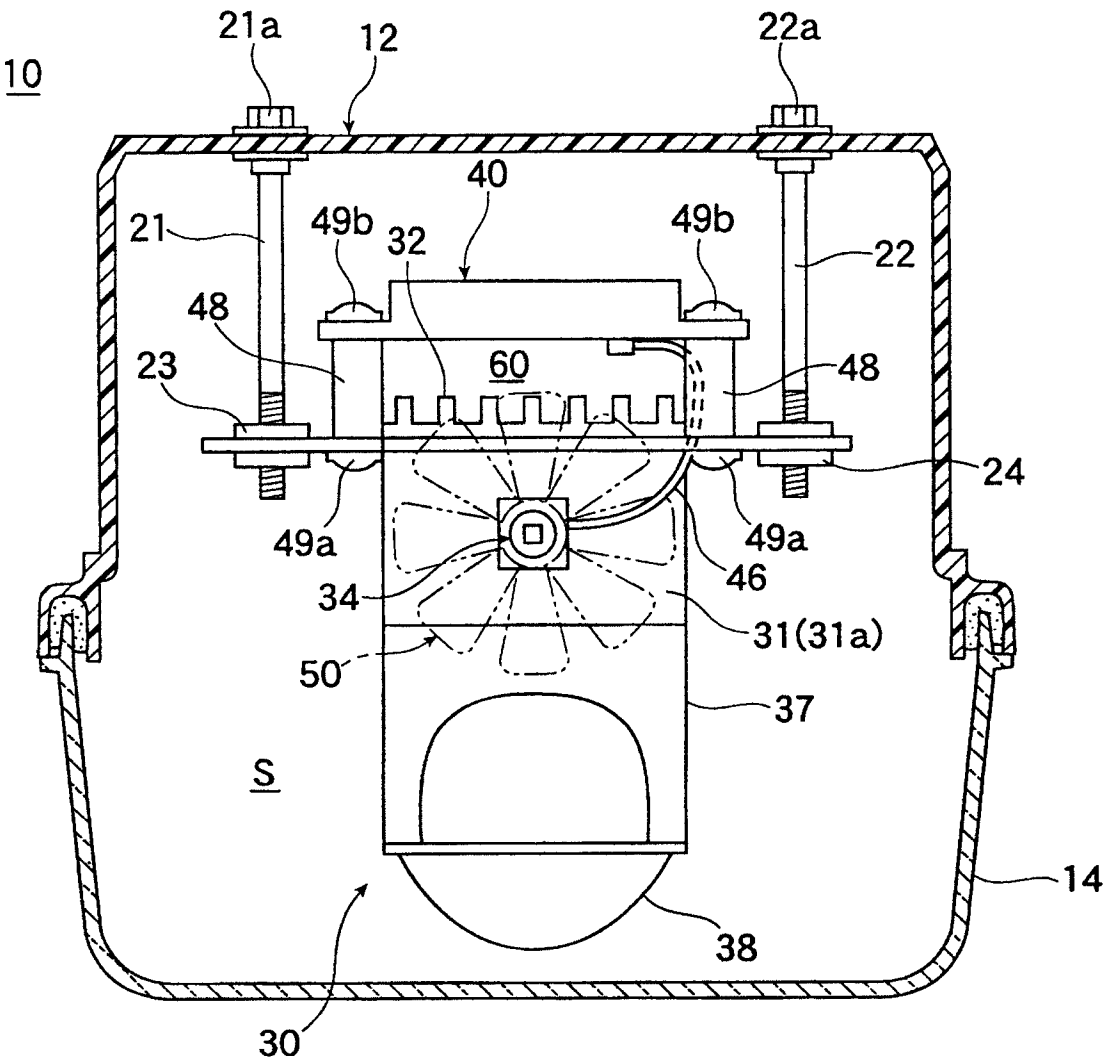
FIG. 4 is a horizontal cross-sectional view of the headlamp (cross-sectional view along a line IV-IV) shown in FIG. 1.

FIGS. 1 to 4 show a vehicular headlamp in accordance with one or more embodiments of the present invention. FIG. 1 is a frontal view of the headlamp. FIG. 2 is a vertical cross-sectional view of the headlamp (cross-sectional view along a line II-II) shown in FIG. 1. FIG. 3 is a vertical cross-sectional view of the headlamp (cross-sectional view along a line III-III shown) in FIG. 1. FIG. 4 is a horizontal cross-sectional view of the headlamp (cross-sectional view along a line IV-IV) shown in FIG. 1.

Referring to these drawings, in a vehicular headlamp 10, a lamp chamber S is formed by a lamp body 12 and a generally plain translucent cover (front cover) 14 that is attached to a front opening portion of the lamp body 12. A projector type light source unit 30 having a light-emitting element 34 as a light source is accommodated inside the lamp chamber S.

The light source unit 30 is formed having a lamp bracket 31 that is made of die-cast aluminum and serves as a metal heat transfer member; a light-emitting element (LED capable of high light flux) 34 that is attached to the lamp bracket 31 and serves as a light source; a reflector 36 made of resin that is attached to the lamp bracket 31 so as to cover the light-emitting element 34, and reflects light emitted from the light-emitting element 34 forward; a projection lens 38 made of resin that is arranged on an optical axis L of the light source unit 30; and a shade 37*a* for cut-off line formation that is made of resin is disposed between the light-emitting element 34 and the projection lens 38.

More specifically, the lamp bracket 31 is formed with a generally oblong shape as viewed from the front, and a generally center portion in the vertical direction thereof is formed with an oblong-shaped forward expanding portion 31*a* that opens downward and rearward. An upper surface of the forward expanding portion 31*a* is attached with the light-emitting element 34 whose irradiation axis faces upward, and also attached with a reflector 36 that opens forward so as to cover over the light-emitting element 34. A shade member 37 has a T-shaped vertical cross section and is fixed by a screw 39 onto a front end portion of the forward expanding portion 31*a*. An upper end edge of the shade member 37 functions as the shade 37*a* for cut-off line formation. The shade member 37 also includes a forward extending portion 37*b* that has a general semicircular shape as viewed from the front and is integratedly joined with the projection lens 38 made of resin.

A lighting circuit 42 that controls lighting of the light-emitting element 34 is integrated into the back of the lamp bracket 31. The lighting circuit 42 is structured as a circuit board 43 that is mounted with electronic components (circuit elements) 44. The lighting circuit 42 is accommodated inside a circuit housing 41 and integrated as a lighting circuit unit 40. A reference numeral 46 in FIG. 4 indicates a lead that connects the lighting circuit 42 and the light-emitting element 34 and is disposed along the side of the lamp bracket 31.

In one or more embodiments, a light-emitting element 34 (LED capable of high light flux) that matches the light intensity required for headlamp light distribution is employed as the light source of the light source unit 30. However, a large amount of heat is generated by the light-emitting element 34. For this reason, it is necessary to effectively cool the light-emitting element 34 and (the electronic components 44 of) the lighting circuit 42 so that the light-emitting element 34 and (the electronic components 44 of) the lighting circuit 42 are not affected by the heat generated by the light-emitting element 34.

Therefore, in one or more embodiments, the lighting circuit unit 40 (lighting circuit 42) is attached to a vertical wall 31*b* of the lamp bracket 31 through a pair of side wall members 48 that are formed of resin and serve as non-heat transfer members. A ventilation passage 60 (see FIGS. 2 and 3) that extends upward and has a horizontally oblong cylindrical shape from a plane view is formed between (the vertical wall 31*b* of) the lamp bracket 31 and the lighting circuit unit 40. A blast fan 50 that serves as blowing means for cooling both the light-emitting element 34 and the lighting circuit 42 is attached to inside the forward expanding portion 31*a* downward of the ventilation passage 60. Reference numerals 49*a*, 49*b* are tightening screws that attach the lamp bracket 31 to the lighting circuit unit through the side wall members 48.

A first heat sink 32 structured by a plurality of heat radiation fins is formed on a rear surface of the vertical wall 31*b* of the lamp bracket 31. A second heat sink 33 structured by a plurality of heat radiation fins is formed in the vicinity of an entrance to the ventilation passage 60 in the lamp bracket 31.

Therefore, a portion of blown air generated by the driving of the blast fan 50 flows upward along the ventilation passage 60 between the lighting circuit unit 40 and (the vertical wall 31*b* of) the lamp bracket 31. Accordingly, this portion of blown air removes heat from (the vertical wall 31*b* of) the lamp bracket 31 and the lighting circuit unit 40 forming the ventilation passage 60, which increases the temperature of the blown air and makes it rise. The blown air then cools and falls as it approaches the lamp body 12 and the front cover 14, and is again sent to the ventilation passage 60 by the blast fan 50. Thus, air convection that circulates around the light source unit 30 (see the arrows in FIG. 2) is generated. In other words, while the blast fan 50 is driving, cold air below the light source unit 30 is constantly guided to the ventilation passage 60 and the air current that flows along (the vertical wall 31*b* of) the lamp bracket 31 and the lighting circuit unit 40 promotes the release of heat from (the vertical wall 31*b* of) the lamp bracket 31 and the lighting circuit unit 40. Thus, effectively cooling the light-emitting element 34 and the lighting circuit 42 is achieved.

In addition, the first heat sink 32 is provided in an area of the vertical wall 31*b* of the lamp bracket 31 that is directly opposite the lighting circuit unit 40, and as shown in FIG. 4, the first heat sink 32 is structured by heat radiation fins that extend in the up-down direction along the ventilation passage 60 and are arranged at regular intervals in the right-left direction (width direction of the ventilation passage). This configuration increases the cooling effect on the light-emitting element 34.

The heat generated by the light-emitting element 34 is transferred to the lighting circuit unit 40 through the lamp bracket 31. However, the resin-made side wall member interposed between the lamp bracket 31 and the lighting circuit unit 40 prevents heat on the lamp bracket 31 side from transferring to the lighting circuit unit 40 side. Therefore, heat generated by the light-emitting element 34 is not prone to transfer to the lighting circuit unit 40 side through the lamp bracket 31, and a structure is achieved in which the lighting circuit 42 is correspondingly less prone to the effects of heat generated by the light-emitting element 34.

In addition, the second heat sink 33 is provided in an area that is directly opposite the blast fan 50 in the vicinity of the entrance to the ventilation passage 60 on the lower surface of the forward expanding portion 31*a*, and the first heat sink 32 is structured by heat radiation fins that extend in the right-left direction and are arranged at regular intervals in the front-back direction. This configuration further increases the cooling effect on the light-emitting element 34.

The second heat sink (heat radiation fins) 33, similar to the first heat sink (heat radiation fins) 32, increases the amount of surface area that comes in contact with blowing air, and thus increases the amount of heat released from the lamp bracket 31. Therefore, in addition to the operation of increasing the cooling effect on the light-emitting element 34, there is an operation of only fresh blown air generated by the blast fan 50 being guided to (the entrance of) the ventilation passage 60, because blown air that contacts and is warmed by the second heat sink (heat radiation fins) 33 is sent sideward of the light source unit 30 (in the right-left direction). As a consequence, the light-emitting element 34 and the lighting circuit 42 are more effectively cooled.

As shown in FIG. 1, the projector type light source unit 30 is supported at three points, namely, a pair of aiming points B, C that are separated in the right-left direction and arranged towards the top of the lamp chamber S interior, and one aiming fulcrum point A that is positioned directly below the aiming point C. Using an aiming mechanism E described later, the projector type light source unit 30 can be respectively tilted around a virtual horizontal tilt axis Lx that passes through the aiming fulcrum point A and is parallel to a leveling axis Lxl that passes through the aiming points B, C, and a virtual vertical tilt axis Ly that passes through the aiming points C, A.

More specifically, two aiming screws 21, 22 are rotatably supported on a back rear wall of the lamp body 10 and extend forward, and rotational operation portions 21*a*, 22*b* are integratedly formed on rear end portions of the aiming screws 21, 22, respectively. Meanwhile, bearing nuts 23, 24 that are threadedly mounted to the aiming screws 21, 22, respectively, are attached to right and left upper portions of the lamp bracket 31. A bearing nut 28 that is threadedly mounted to a rotational drive shaft 27 of the leveling actuator 26, which is fixed to the inside of the lamp body 10, is attached on the side of a lower portion of the lamp bracket 31 directly underneath the bearing nut 24. One or more embodiments have an auto-leveling mechanism in which a tilt angle of a vehicle axle (longitudinal axle) with respect to the road surface is measured by a tilt sensor, and an ECU controls the driving of the leveling actuator 26 such that the tilt amount detected by the tilt sensor remains constant (the light source unit 30 is tiltably adjusted around the leveling axis Lxl such that the optical axis L of the light source unit 30 remains a constant angle of inclination with respect to the road surface).

If a tool such as a wrench or the like is used to rotate (the rotational operation portions 21*a*, 21*b* of) the aiming screws 21, 22 by generally identical amounts so that the bearing nuts 23, 24 advance or retreat along the aiming screws 21, 22, the light source unit 30 (lamp bracket 31) tilts around the horizontal tilt axis Lx and the optical axis L of the light source unit 30 tilts upward or downward. Alternatively, if a tool such as a wrench or the like is used to rotate only the aiming screw 21 so that the bearing nut 23 threadedly mounted to the aiming screw 21 advances or retreats, the light source unit 30 (lamp bracket 31) tilts around the vertical tilt axis Ly and the optical axis L of the light source unit 30 tilts rightward or leftward.

In other words, the aiming mechanism E that tilts the optical axis L of the light source unit 30 (lamp bracket 31) in the up, down, right, and left directions is structured by the pair of aiming screws 21, 22, the bearing nuts 23, 24 that are the aiming points B, C and threadedly mounted to the aiming screws 21, 22, and the bearing nut 28 that is the aiming fulcrum point A.

In one or more embodiments as described above, the light source unit 30 having the light-emitting element (LED capable of high light flux) 34 as a light source is integratedly attached with the lighting circuit unit 40 and also integrated with the blast fan 50 for cooling both the light-emitting element 34 and the lighting circuit unit 40 (lighting circuit 42). Therefore, even if leveling and aiming (tilt adjustments of the light source unit 30) are performed, the arrangement of the blast fan 50 with respect to the light-emitting element 34 and the lighting circuit unit 40 does not change. Accordingly, the direction, strength, and amount of effective blown air for cooling the light-emitting element 34 and the lighting circuit unit 40 is maintained constant and does not change before or after aiming. Thus, a constant heat release effect is secured for (i.e., a heat release operation acts on) the light-emitting element 34 and the lighting circuit unit 40. As a consequence, it is possible to avoid troubles caused by heat, such as reduced luminous efficiency, variations in the color of light emitted, and failures of the electronic components 44 structuring the lighting circuit 42.

The embodiments described above have a structure in which one projector type light source unit 30 is accommodated inside the lamp chamber S formed by the lamp body 12 and the translucent cover 14 attached to a front opening portion thereof, and the projector type light source unit 30 is supported tiltable with respect to the lamp body 12 by the aiming mechanism E. However, a light source unit assembly as an integration of a plurality of aligned projector type light source units 30 may be accommodated inside a lamp chamber, and the light source unit assembly may be supported tiltable with respect to the lamp body 12 by an aiming mechanism. In other words, a structure may be used in which headlamp light distribution can be formed by combining the light distribution from a plurality of projector type light source units.

In the embodiments described above, the light source unit accommodated in the lamp chamber is structured as the projector type light source unit 30, wherein the projection lens 32 is integrated with a front end portion of the lamp bracket 31 that is a metal heat transfer member. However, a reflector type light source unit may be used, wherein a reflector having a parabolic configuration that reflects and distributes light emitted from the light-emitting element 34 forward is provided on the lamp bracket that is a metal heat transfer member.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF THE REFERENCE NUMERALS

10 VEHICULAR HEADLAMP
12 LAMP BODY

14 TRANSLUCENT COVER (FRONT COVER)
S LAMP CHAMBER SPACE
E AIMING MECHANISM
21, 22 AIMING SCREW
23, 24, 28 BEARING NUT
26 LEVELING ACTUATOR
27 DRIVE SHAFT OF LEVELING ACTUATOR
A AIMING FULCRUM POINT
B, C AIMING POINT
30 PROJECTOR TYPE LIGHT SOURCE UNIT
L OPTICAL AXIS OF PROJECTOR TYPE LIGHT SOURCE UNIT
31 LAMP BRACKET AS METAL HEAT TRANSFER MEMBER
31*a* FORWARD EXPANDING PORTION
32 HEAT RADIATION FIN FORMING FIRST HEAT SINK
33 HEAT RADIATION FIN FORMING SECOND HEAT SINK
34 LIGHT-EMITTING ELEMENT AS LIGHT SOURCE (LED CAPABLE OF HIGH LIGHT FLUX)
36 REFLECTOR
38 PROJECTION LENS
37*a* SHADE FOR CUT-OFF LINE FORMATION
40 LIGHTING CIRCUIT UNIT
42 LIGHTING CIRCUIT
43 CIRCUIT BOARD
44 CIRCUIT ELEMENT (ELECTRONIC COMPONENT)
46 LEAD CONNECTING LIGHT-EMITTING ELEMENT AND LIGHTING CIRCUIT
48 SIDE WALL MEMBER FORMED AS NON-HEAT TRANSFER MEMBER
50 BLAST FAN AS BLOWING MEANS
60 CYLINDRICAL VENTILATION PASSAGE

What is claimed is:

1. A vehicular headlamp, wherein a light source unit for light distribution formation is accommodated inside a lamp chamber defined by a lamp body and a front cover, the vehicular headlamp comprising:

a metal heat transfer member that serves as a light source unit structural member;

a light-emitting element that serves as a light source;

blowing means for cooling the light-emitting element provided inside the lamp chamber; and a lighting circuit that controls lighting of the light-emitting element, wherein the light-emitting element, the blowing means, and the lighting circuit are each attached to the metal heat transfer member, wherein the lighting circuit is formed from a circuit board mounted with a circuit element, wherein a ventilation passage for air blown from the blowing means is formed between the circuit board and the metal heat transfer member, wherein the ventilation passage is disposed apart from the metal heat transfer member, and wherein the vehicular headlamp further comprises:

a heat radiation fin formed in an area directly opposite the blowing means in a vicinity of an entrance to the ventilation passage on the metal heat transfer member, and wherein the heat radiation fin is generally orthogonal to the ventilation passage and extends in a right-left direction, and another heat radiation fin formed on a back surface side of the heat transfer member that is directly opposite the lighting circuit unit.

2. The vehicular headlamp according to claim 1, wherein the lighting circuit is attached to a back surface side of the metal heat transfer member through a non-heat transfer member that structures a side wall facing the ventilation passage.

3. The vehicular headlamp according to claim 1, wherein the ventilation passage is formed with a cylindrical shape that extends upward.

4. The vehicular headlamp according to claim 2, wherein the side wall is formed of resin.

5. The vehicular headlamp according to claim 1, wherein the blowing means is a blast fan.

6. A method of manufacturing a vehicular headlamp, wherein a light source unit for light distribution formation is accommodated inside a lamp chamber defined by a lamp body and a front cover, the method comprising:

providing a metal heat transfer member that serves as a light source unit structural member;

attaching a light-emitting element that serves as a light source to the metal heat transfer member;

attaching blowing means for cooling the light-emitting element provided inside the lamp chamber to the metal heat transfer member;

attaching a lighting circuit that controls lighting of the light-emitting element to the metal heat transfer member, forming the lighting circuit from a circuit board mounted with a circuit element;

forming a ventilation passage for air blown from the blowing means between the circuit board and the metal heat transfer member, wherein the ventilation passage is disposed apart from the metal heat transfer member;

forming a heat radiation fin in an area directly opposite the blowing means in a vicinity of an entrance to the ventilation passage on the metal heat transfer member, and wherein the heat radiation fin is generally orthogonal to the ventilation passage and extends in a right-left direction; and forming another heat radiation fin on a back surface side of the heat transfer member that is directly opposite the lighting circuit unit.

7. The method according to claim 6 further comprising:

attaching the lighting circuit to a back surface side of the metal heat transfer member through a non-heat transfer member that structures a side wall facing the ventilation passage.

8. The method according to claim 6, wherein the ventilation passage is formed with a cylindrical shape that extends upward.

9. The method according to claim 7, wherein the side wall is formed of resin.

10. The method according to claim 6, wherein the blowing means is a blast fan.

11. A vehicular headlamp, wherein a light source unit for light distribution formation accommodated inside a lamp chamber defined by a lamp body and a front cover, comprising:

a metal heat transfer member that serves as a light source unit structural member;

a light-emitting element that serves as a light source;

a fan for cooling the light-emitting element provided inside the lamp chamber;

a lighting circuit that controls lighting of the light-emitting element, wherein the light-emitting element, the fan, and the lighting circuit are each attached to the metal heat transfer member, wherein the lighting circuit is formed from a circuit board mounted with a circuit element, wherein a ventilation passage for air blown from the fan is formed between the circuit board and the metal heat transfer member, wherein the ventilation passage is formed with a cylindrical shape that extends upward and is disposed apart from the metal heat transfer member, wherein the lighting circuit is attached to a back surface side of the metal heat transfer member through a non-heat transfer member that structures a side wall facing the ventilation passage, wherein the side wall is formed of resin, and;

a heat radiation fin formed in an area directly opposite the fan in a vicinity of an entrance to the ventilation passage on the metal heat transfer member, wherein the heat radiation fin is generally orthogonal to the ventilation passage and extends in a right-left direction; and another heat radiation fin formed on the back surface side of the heat transfer member that is directly opposite the lighting circuit unit.

12. The vehicular headlamp according to claim 11 further comprising:

an aiming mechanism adapted to tilt the metal heat transfer member with respect to the lamp body, wherein the light-emitting element, the fan, and the lighting circuit are each attached to the metal heat transfer member such that an arrangement of the fan with respect to the light-emitting element and the lighting circuit unit does not change regardless of tilting of the metal heat transfer member by the aiming mechanism.

* * * * *